US007244514B2

(12) United States Patent
Hara et al.

(10) Patent No.: US 7,244,514 B2
(45) Date of Patent: Jul. 17, 2007

(54) CORROSION RESISTANT PART

(75) Inventors: Masaaki Hara, Ikoma (JP); Wataru Yamauchi, Sakai (JP); Kenji Matsuda, Sakai (JP); Masayoshi Kihara, Sakai (JP)

(73) Assignee: Shimano, Inc., Sakai-ku, Sakai, Osaka (JP)

( * ) Notice: Subject to any disclaimer, the term of this patent is extended or adjusted under 35 U.S.C. 154(b) by 0 days.

(21) Appl. No.: 10/904,792

(22) Filed: Nov. 29, 2004

(65) Prior Publication Data

US 2005/0260424 A1 Nov. 24, 2005

(30) Foreign Application Priority Data

Dec. 4, 2003 (JP) ..... 2003-406388

(51) Int. Cl.
*B32B 15/04* (2006.01)
*B32B 15/08* (2006.01)
*B32B 15/20* (2006.01)

(52) U.S. Cl. ..... 428/626; 428/213; 428/215; 428/457; 428/472.2; 428/654

(58) Field of Classification Search ..... 428/624, 428/626, 629, 632, 633, 650, 654, 213, 215, 428/336, 339, 457, 461, 469, 472.2, 542.2
See application file for complete search history.

(56) References Cited

U.S. PATENT DOCUMENTS 3,878,078 A * 4/1975 Tanaka et al. ..... 204/477
5,753,322 A * 5/1998 Yamaguchi et al. ..... 428/14

FOREIGN PATENT DOCUMENTS

| | | | |
|---|---|---|---|
| GB | 1126855 A | | 9/1968 |
| GB | 1134000 A | | 11/1968 |
| JP | 50-019290 B | | 7/1975 |
| JP | 06-192888 | * | 7/1994 |
| JP | 06-192888 A | | 7/1994 |
| JP | 2000-149913 | * | 5/2000 |
| WO | WO 2005/014894 A1 | | 2/2005 |

OTHER PUBLICATIONS

Wood, William G., "Metal Handbook 9th Edition, v. 5, Surface Cleaning, Finishing and Coating," 1982, American Society for Metals, USA, no month.
European search report for EP 04028690.8, the European application that corresponds to this application, dated Nov. 3, 2006.

* cited by examiner

*Primary Examiner*—Michael E. Lavilla
(74) *Attorney, Agent, or Firm*—James A. Deland

(57) ABSTRACT

A corrosion resistant part comprises an aluminum alloy part main body, an alumite layer disposed on the part main body, and a corrosion resistant layer disposed on the alumite layer. The part main body has a normal portion and a flawed portion so that the alumite layer comprises a normal portion alumite layer formed on the normal portion and a flawed portion alumite layer formed on the flawed portion, and the corrosion resistant layer comprises a normal portion corrosion resistant layer formed on the normal portion and a flawed portion corrosion resistant layer formed on the flawed portion. The normal portion alumite layer has a thickness between approximately 0.5 microns and approximately 5.0 microns. The corrosion resistant layer is formed from an ionic resin and has a thickness less than or equal to approximately 5 microns.

9 Claims, 3 Drawing Sheets

Fig. 1 (B) (Prior Art)

CORROSION RESISTANT PART

BACKGROUND OF THE INVENTION

The present invention is directed to parts used in an outdoor or other corrosive environment and, more particularly, to an aluminum alloy part used in a corrosive environment.

Many parts used in an outdoor or other corrosive environment are manufactured from aluminum alloys. Such parts often are used in airplanes, automobiles, bicycles and fishing equipment. While aluminum alloys achieve strengths comparatively higher than steel through the use of a heat treatment, aluminum alloys also have relatively inferior corrosion resistance. Consequently, a surface treatment known as an alumite process normally is applied to aluminum alloy parts as a means to improve corrosion resistance.

Unfortunately, the alumite process itself creates some problems as shown in FIGS. 1(A)-1(C). As shown in FIG. 1(A), metallic compounds 215 (e.g., $CuAl_2$, copper or zinc) may exist within portions of a part main body 210 of an aluminum alloy part 200. When the alumite process is applied to the part main body 210 of aluminum alloy part 200 to form an alumite coating 221, the metallic compounds 215 may undergo priority fusing, thus creating a coating flaw 222 in the form of a void or recess as shown in FIG. 1(B). As a result, the alumite coating 221 does not adequately cover all of the aluminum alloy part 200. Then, when aluminum alloy part 200 is subjected to the corrosive environment, corrosion expands coating flaw 222 as shown in FIG. 1(C). Sometimes a sealing process is applied to reduce corrosion of coating flaw 222, but such sealing processes tend to inadequately control the spread of corrosion.

Japanese Laid-Open Patent Publication No. 1994-192888 discloses a method intended to improve the corrosion resistance of an aluminum alloy part by increasing the thickness of an alumite layer and by electrodepositing a cation resin onto the aluminum alloy part after the alumite process. While increasing the thickness of the alumite layer may improve corrosion resistance, it becomes more difficult to maintain a high-quality metallic luster of the aluminum alloy part. On the other hand, if the alumite process is not applied to the aluminum alloy part, then good corrosion resistance of the aluminum alloy part is lost.

SUMMARY OF THE INVENTION

The present invention is directed to various features of an aluminum alloy part and methods for manufacturing such a part. In one embodiment, a corrosion resistant part is provided for use in a corrosive environment. The part comprises an aluminum alloy part main body, an alumite layer disposed on the part main body, and a corrosion resistant layer disposed on the alumite layer. The part main body has a normal portion and a flawed portion. Thus, the alumite layer comprises a normal portion alumite layer formed on the normal portion and a flawed portion alumite layer formed on the flawed portion, and the corrosion resistant layer comprises a normal portion corrosion resistant layer formed on the normal portion and a flawed portion corrosion resistant layer formed on the flawed portion. The normal portion alumite layer has a thickness between approximately 0.5 microns and approximately 5.0 microns. The corrosion resistant layer is formed from an ionic resin and has a thickness less than or equal to approximately 5 microns.

Additional inventive features will become apparent from the description below, and such features alone or in combination with the above features may form the basis of further inventions as recited in the claims and their equivalents.

BRIEF DESCRIPTION OF THE DRAWINGS

FIG. 1(B) shows the portion of an aluminum alloy part with a flaw caused by an alumite process;

DETAILED DESCRIPTION OF THE EMBODIMENTS

Figures 1A, 1C:
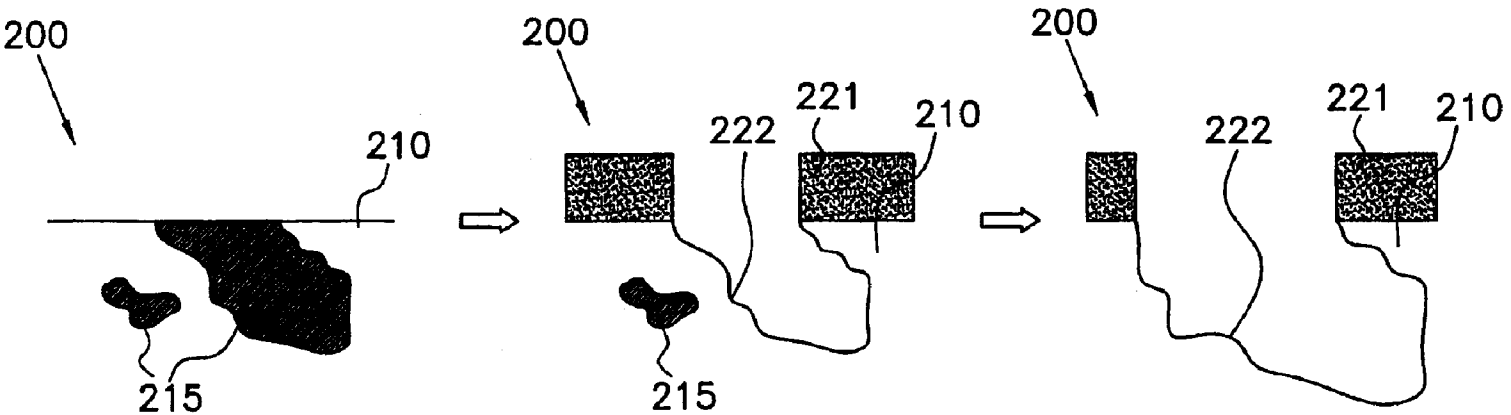
Fig. 1(A) (Prior Art)
Fig. 1(C) (Prior Art)
FIG. 1(A) shows a portion of an aluminum alloy part with embedded metallic components.
FIG. 1(C) shows the portion of an aluminum alloy part after corrosive expansion of the flaw.
Figure 2:
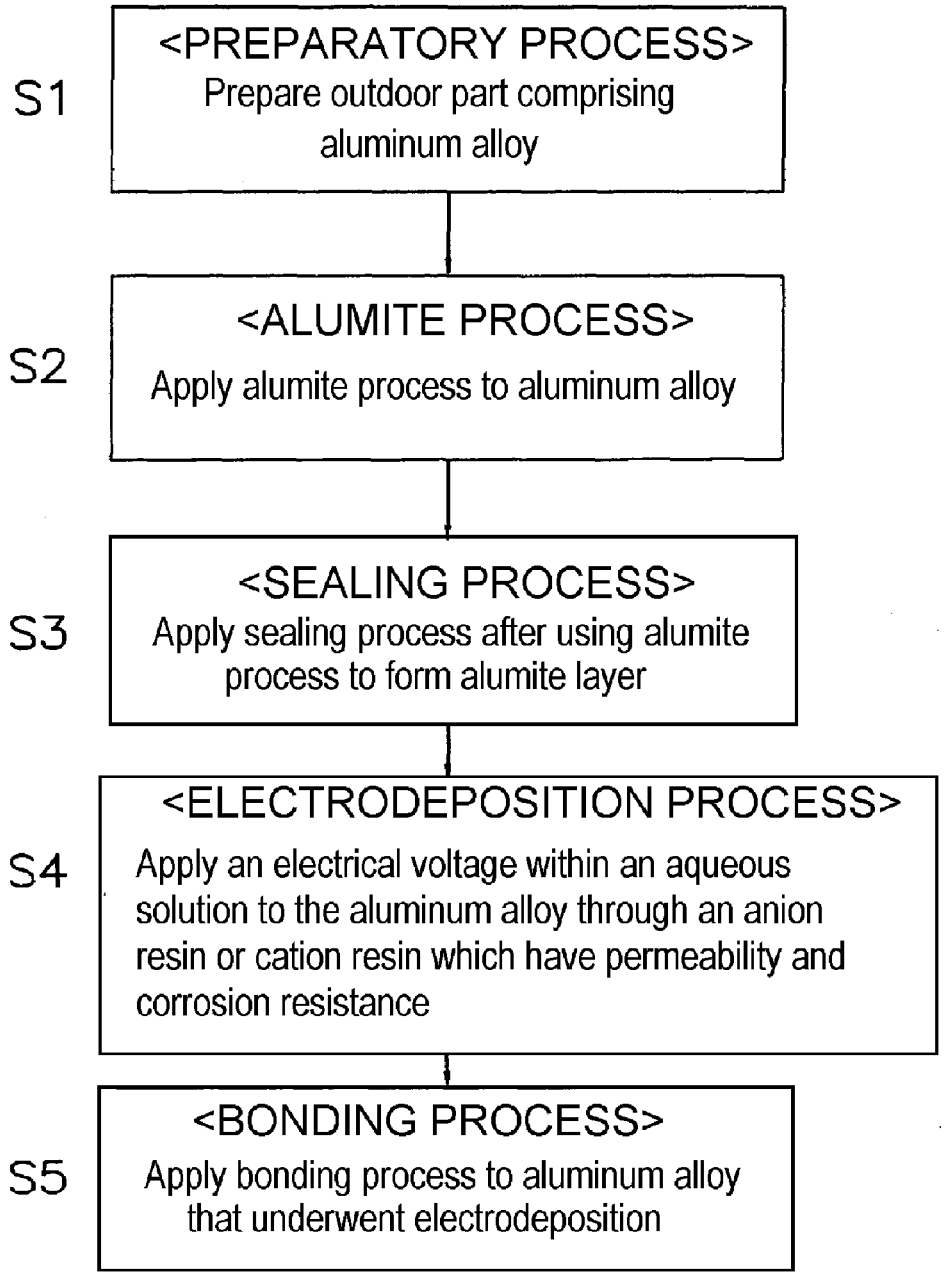
FIG. 2 is a flow chart of an embodiment of a process for forming an aluminum alloy part.
Figures 3A, 3B, 3C:
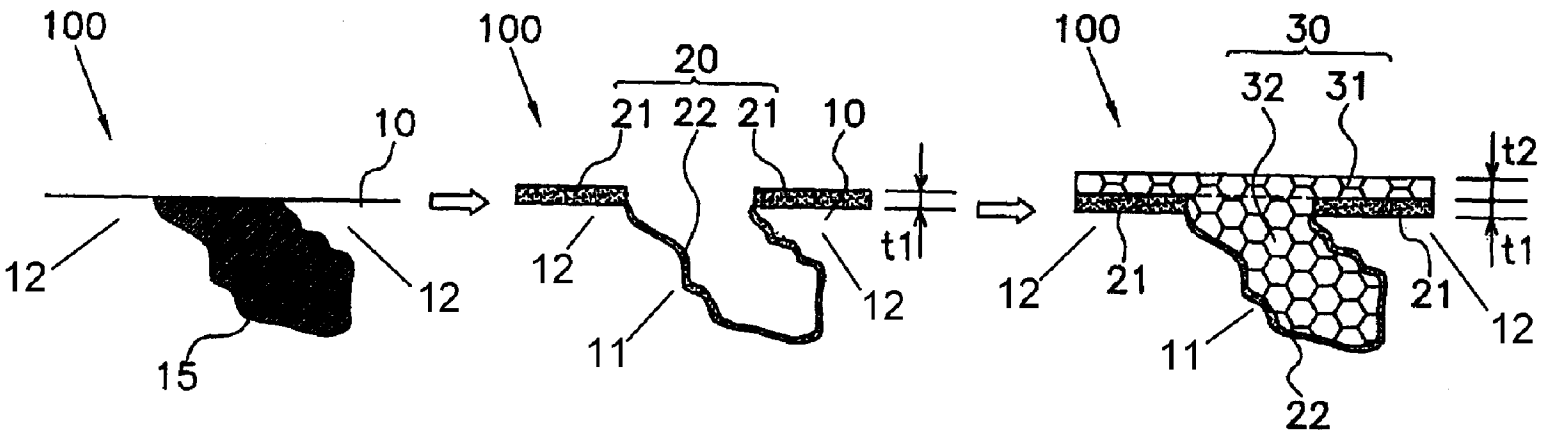
FIG. 3(A) shows a portion of an aluminum alloy part with embedded metallic components.
FIG. 3(B) shows the portion of an aluminum alloy part after the application of an embodiment of an alumite process.
FIG. 3(C) shows the portion of an aluminum alloy part after the application of a corrosion resistant layer.

FIG. 2 is a flow chart of an embodiment of a process for forming an aluminum alloy part 100, and FIGS. 3(A)-3(C) show aluminum alloy part 100 after undergoing the various processes. As shown in FIG. 2, Step S1 is a preparatory process that prepares a part main body 10 of aluminum alloy part 100 from an aluminum alloy that underwent a conventional forging process, a heat treatment process, a machining process and/or a buffing/polishing process. Aluminum alloy part 100 may be prepared from A2014 material, A7075 material, A6151 material, A6063 material or some other suitable material. The resulting aluminum alloy part 100 is shown in FIG. 3(A). As shown in FIG. 3(A), a metallic compound 15, such as CuAl2, is included in part main body 10.

In Step S2, part main body 10 is subjected to an alumite process. Conventional alumite processes are performed using superimposed direct and alternating electrical currents. In this embodiment, however, direct electrical current is used, and the process is performed within sulfuric acid. More specifically, the alumite process is performed by immersing part main body 10 in sulfuric acid and applying a direct current with a current density between approximately 0.1 $A/cm^2$ and approximately 6 $A/cm^2$, preferably between approximately 0.5 $A/cm^2$ and approximately 3 $A/cm^2$, to produce the structure shown in FIG. 3(B). Higher current density can cause unevenness in an alumite layer 20 discussed below, whereas lower current density reduces corrosion and wear resistance. Metallic compound 15 is preferentially dissolved during the alumite process, thus creating a recessed flawed portion 11 of part main body 10. However, compared to flaws that occur due to an alternating electrical current alumite process, flaws that occur due to a direct current alumite process have relatively smaller bore diameters and reach to a depth of approximately 2.7 microns. This improves the appearance of aluminum alloy part 100. Of course, a flawed part need not be recessed, and it may even be 0 microns.

The alumite process also forms an alumite layer 20 on part main body 10. Alumite layer 20 comprises a normal portion alumite layer 21, disposed on flat normal portions 12 of part main body 10, and a flawed portion alumite layer 22 disposed on flawed portion 11 of part main body 10. In this embodiment, a thickness t1 of normal portion alumite layer 21 is controlled to be from approximately 0.5 microns and approximately 5 microns, preferably 2.0 microns, such that the metallic luster of aluminum alloy part 100 is not lost. The thickness of flawed portion alumite layer 22 is approximately 1.0 micron.

Alumite layer 20 has properties closely resembling an insulator. However, because of the different thicknesses of normal portion alumite layer 21 and flawed portion alumite layer 22, the electrical resistances of the two layers will differ. More specifically, an electrical resistance of normal portion alumite layer 21 will be greater than an electrical resistance of flawed portion alumite layer 22, so flawed portion alumite layer 22 will have good conductivity relative to normal portion alumite layer 21.

In Step S3, part main body 10 is subjected to a sealing process to improve corrosion resistance. In this embodiment, the sealing process is performed for a period of between approximately 1 minute and approximately 60 minutes, preferably approximately 10 minutes, in an acetic acid nickel solution at a temperature between approximately 80° C. and approximately 100° C., preferably 90° C. Although the sealing process produces a hydration reaction in one portion of the oxidation coating, comparatively stable hydrates can easily be obtained by these conditions. The differences in the conductivity of normal portion alumite layer 21 and the flawed portion alumite layer 22 still remain after this sealing process.

In Step S4, part main body 10 is subjected to an ionic resin electrodeposition process. More specifically, a voltage of between approximately 15 volts and approximately 70 volts, preferably between approximately 30 volts and approximately 50 volts, is applied with part main body 10 immersed within an aqueous solution to precipitate anion resin or cation resin. Preferably, a resin with high light permeability and excellent corrosion resistance is used for this purpose. This produces a corrosion resistant layer 30 comprising an anionic resin or cationic resin that restores the surface of the flawed portion 11 to the normal portion as shown in FIG. 3(C).

As noted above, the conductivity of normal portion alumite layer 21 is less than flawed portion alumite layer 22, even after applying the sealing process in Step S3. Therefore, ionic resin with even higher light permeability and excellent corrosion resistance precipitates more readily through selective conduction onto flawed portion alumite layer 22 than onto normal portion alumite layer 21. This results in a corrosion resistant layer 30 comprising a normal portion corrosion resistant layer 31, disposed on normal portion alumite layer 21, and a flawed portion corrosion resistant layer 32 that is preferentially precipitated onto flawed portion alumite layer 22. A thickness t2 of normal portion corrosion resistant layer 31 is controlled to be 5 microns or less, preferably 0.7 microns, to control the appearance of the film coating (e.g., reduce muddiness, roughness, cloudiness, etc.). As a result of the foregoing process steps, corrosion resistance is improved while maintaining high-quality metallic luster of the aluminum alloy.

In Step S5, aluminum alloy part 100 is subjected to a high temperature bonding and drying process to strengthen the combination of materials coated on the surface of aluminum alloy part 100. More specifically, it is possible to change the organic compound of the ionic resin to a macromolecular organic compound. A double combination or triple combination portion with a molecular structure can be opened and a molecular bridging action brought into play to further improve corrosion. Applying the bonding and drying process in this manner makes it possible to additionally improve the corrosion resistance while maintaining high-quality metallic luster of the aluminum alloy.

While the above is a description of various embodiments of inventive features, further modifications may be employed without departing from the spirit and scope of the present invention. For example, the size, shape, location or orientation of the various components may be changed as desired. Components that are shown directly connected or contacting each other may have intermediate structures disposed between them. The functions of one element may be performed by two, and vice versa. The structures and functions of one embodiment may be adopted in another embodiment. It is not necessary for all advantages to be present in a particular embodiment at the same time. Every feature that is unique from the prior art, alone or in combination with other features, also should be considered a separate description of further inventions by the applicant, including the structural and/or functional concepts embodied by such feature(s). Thus, the scope of the invention should not be limited by the specific structures disclosed or the apparent initial focus or emphasis on a particular structure or feature.

What is claimed is:

1. A corrosion resistant part that is exposed to a corrosive environment when in normal use, wherein the part comprises:

a part main body, wherein the part main body comprises an aluminum alloy with a normal portion and a flawed portion;

wherein the part main body has a recess forming the flawed portion;

an alumite layer comprising:

a normal portion alumite layer disposed on the normal portion, wherein the normal portion alumite layer has a thickness between approximately 0.5 microns and approximately 5.0 microns; and a flawed portion alumite layer disposed on the flawed portion;

an ionic resin corrosion resistant layer, wherein the corrosion resistant layer comprises:

a normal portion corrosion resistant layer disposed on the normal portion, wherein the normal portion corrosion resistant layer has a thickness less than or equal to approximately 5 microns; and a flawed portion corrosion resistant layer disposed on the flawed portion.

2. The part according to claim 1 wherein the flawed portion is formed from an alumite process.

3. The part according to claim 1 wherein the part main body has a recess forming the flawed portion, and wherein the recess is formed from an alumite process.

4. The part according to claim 1 wherein a thickness of the normal portion corrosion resistant layer is different from a thickness of the flawed portion corrosion resistant layer.

5. The part according to claim 4 wherein the thickness of the normal portion corrosion resistant layer is less than the thickness of the flawed portion corrosion resistant layer.

6. The part according to claim 1 wherein a thickness of the normal portion alumite layer is different from a thickness of the flawed portion alumite layer.

7. The part according to claim 6 wherein the thickness of the normal portion alumite layer is greater than the thickness of the flawed portion alumite layer.

8. The part according to claim 1 wherein the part main body has a recess forming the flawed portion, wherein the recess is formed from an alumite process, wherein a thickness of the normal portion corrosion resistant layer is different from a thickness of the flawed portion corrosion resistant layer, and wherein a thickness of the normal portion alumite layer is different from a thickness of the flawed portion alumite layer.

9. The part according to claim 8 wherein the thickness of the normal portion corrosion resistant layer is less than the thickness of the flawed portion corrosion resistant layer, and wherein the thickness of the normal portion alumite layer is greater than the thickness of the flawed portion alumite layer.

* * * * *